US007867008B1

(12) United States Patent
Lin

(10) Patent No.: US 7,867,008 B1
(45) Date of Patent: Jan. 11, 2011

(54) WATER-PROOF CONNECTOR ASSEMBLY

(75) Inventor: Chih-Hsin Lin, Xianxi Township, Changhua County (TW)

(73) Assignee: K.S. Terminals Inc., Changhua County (TW)

( * ) Notice: Subject to any disclaimer, the term of this patent is extended or adjusted under 35 U.S.C. 154(b) by 0 days.

(21) Appl. No.: 12/860,587

(22) Filed: Aug. 20, 2010

(51) Int. Cl.
*H01R 13/627* (2006.01)

(52) U.S. Cl. ..... 439/350; 439/352; 439/357

(58) Field of Classification Search ..... 439/350, 439/352, 357, 358, 362
See application file for complete search history.

(56) References Cited

U.S. PATENT DOCUMENTS 7,524,205 B1 * 4/2009 Lee ..... 439/372

* cited by examiner

*Primary Examiner*—Tho D Ta
(74) *Attorney, Agent, or Firm*—Ming Chow; Sinorica, LLC

(57) ABSTRACT

Disclosed is a water-proof connector assembly which comprises a first connecting device, a second connecting device and a fastener. The first connecting device includes a first casing, a male conductive terminal, a water-resisting member and a first screwing member. The first casing, being provided successively a first section, a second section, a third section and a fourth section, has a first inner hole. The second connecting device includes a second casing, a female conductive terminal which allows the male conductive terminal to insert for conducting electricity, a second water-proof sleeve and a second screwing member. The second casing, being provided successively a fifth section, a sixth section and a seventh section, has a second inner hole. The fastener is mounted around and movable on a first outer surface of the first section and the second section of the first casing between a predetermined first position and a predetermined second position.

9 Claims, 5 Drawing Sheets

100

WATER-PROOF CONNECTOR ASSEMBLY

BACKGROUND OF THE INVENTION

1. Technical Field

The present invention relates to a connector, and more particularly, to a connector with water-proof capability.

2. Description of Related Art

Connectors have been extensively used in various industries as well as mechanical and electrical apparatuses to allow users to therethrough rapidly transmit data, signals and electric power as desired. The advent of connectors speeds up receipt of data and makes people's daily life more conveniences.

Connectors are widely applicable, and many applications thereof in our daily life need connectors to be exposed in the atmosphere. Since a connector implements conductive terminals as contacts for electrical connection, two coupled connectors without any water-proof structure therebetween are likely to, due to damp or moisture, have a short circuit that may destroy the transmission of the connectors and make the connectors unusable.

In addition, two coupled connectors without any reinforcing structure therebetween for securing the connection are likely to be disconnected under an external impact and have the transmission accidentally interrupted. As an even worse consequence, electric leakage may take place between the connectors and bring a user who touches the terminals with the risk of an electric shock or other accidents.

SUMMARY OF THE INVENTION

To overcome the shortcomings of the prior arts mentioned above, the present invention provides a water-proof connector assembly. The water-proof connector assembly comprises a first connecting device, a second connecting device and a fastener, wherein the first connecting device, the second connecting device and the fastener are assembled along a predetermined axis. The first connecting device includes a first casing, a male conductive terminal, a water-resisting member and a first screwing member. The second connecting device includes a second casing, a female conductive terminal, a second water-proof sleeve and a second screwing member. The aforementioned first casing, the second casing and the fastener are all tubular in shape.

The first casing has a first inner hole extending along the above-mentioned predetermined axis. The first casing is provided with successively a first section, a second section, a third section and a fourth section along the predetermined axis. The second section is sunken inwardly to form a pair of recessed portions. The first section has a pair of through holes extending along the predetermined axis. Each of the pair of through holes passes through each of the pair of recessed portion through a pair of first openings. The pair of recessed portions are further provided with a pair of first retaining areas, which are disposed at a pair of outer sides of the pair of first openings.

The second casing has a second inner hole extending along the above-mentioned predetermined axis. The second casing is provided with successively a fifth section, a sixth section and a seventh section along the predetermined axis. The fifth section engages with the first inner hole of the first casing. The second casing further comprises a pair of retaining arms, which are extended from a top of the sixth section along the predetermined axis and located outside the fifth section. The pair of retaining arms have a pair of terminals projecting outwardly to form a pair of projecting portions. The pair of projecting portions have a pair of second retaining areas formed at a side adjacent to each of the pair of retaining arm. Each of the pair of projecting portions passes through each of the pair of through holes of the first casing to engage with each of the pair of recessed portions.

The fastener has a third inner hole extending along the above-mentioned predetermined axis. The fastener is mounted around the first section and the second section of the first casing, thereby the fastener is movable on a first outer surface of the first section and the second section between a predetermined first position and a predetermined second position. In addition, the fastener has a pair of tongues extending along the predetermined axis. Therefore, when the fastener is located at the predetermined first position on the assembled first connecting device and the second connecting device, each of the pair of tongues is positioned below each of the pair of projecting portions of the second casing. When the fastener is located at the predetermined second position, each of the pair of tongues is no more positioned below each of the pair of projecting portions of the second casing.

Accordingly, the primary object of the present invention is to provide a water-proof connector assembly. The water-proof connector assembly comprises a first connecting device, a second connecting device and a fastener. The first connecting device includes a first casing, which has a first section, a second section, a pair of recessed portions and a pair of first retaining areas. The second connecting device includes a second casing, which has a pair of projecting portions and a pair of second retaining areas. The fastener has a pair of tongues and is mounted around the first section and the second section of the first casing. The fastener is movable on a first outer surface of the first section and the second section between a predetermined first position and a predetermined second position. Therefore, when the fastener is located at the predetermined first position on the assembled first connecting device and the second connecting device, each of the pair of tongues is positioned below each of the pair of projecting portions of the second casing. Besides, each of the pair of second retaining areas of each of the pair of projecting portions contacts with each of the pair of first retaining areas of the first casing. Hence, the water-proof connector assembly of the present invention implements the fastener to secure connection between the first connecting device and the second connecting device, which is unlikely to loose or be taken apart due to external impact or unintentional force, so as to ensure durable electrical conductivity of the water-proof connector assembly.

Another object of the present invention is to provide a water-proof connector assembly. The water-proof connector assembly comprises a first connecting device, a second connecting device and a fastener. The first connecting device includes a first casing, which has a first section, a second section. The first section has a pair of second retaining holes. The second connecting device includes a second casing, which has a sixth section. The sixth section has a pair of first retaining holes. The fastener further includes a pair of teeth extruded inwardly from a wall of the third inner hole. The fastener is mounted around the first section and the second section of the first casing. The fastener is movable on a first outer surface of the first section and the second section between a predetermined first position and a predetermined second position. When the fastener is located at the predetermined first position, each of the pair of teeth engages with each of the pair of first retaining holes. Hence, the water-proof connector assembly of the present invention implements the fastener to secure connection between the first connecting device and the second connecting device via the pair of teeth, which is unlikely to loose or be taken apart due to external impact or unintentional force, so as to ensure durable electrical conductivity of the water-proof connector assembly.

Yet another object of the present invention is to provide a water-proof connector assembly. The water-proof connector assembly comprises a first connecting device, a second connecting device and a fastener. The first connecting device includes a first casing, which has a first section, a second section. The first section has a pair of second retaining holes. The second connecting device includes a second casing, which has a sixth section. The sixth section has a pair of first retaining holes. The fastener further includes a pair of teeth extruded inwardly from a wall of the third inner hole. The fastener is mounted around the first section and the second section of the first casing. The fastener is movable on a first outer surface of the first section and the second section between a predetermined first position and a predetermined second position. When the fastener is located at the predetermined second position, each of the pair of teeth engages with each of the pair of second retaining holes so that the fastener uses the pair of teeth to firmly hold the first section and the second section of the first casing without hindering the connection between the first connecting device and the second connecting device.

Still another object of the present invention is to provide a water-proof connector assembly. The water-proof connector assembly comprises a first connecting device, a second connecting device and a fastener. While the first connecting device has a first water-proof sleeve, the second connecting device has a second water-proof sleeve. Therefore, in virtue of the first water-proof sleeve and the second water-proof sleeve, damp or moisture is blocked from entering the first connecting device and the second connecting device, thereby improving the water-proof connector assembly in water-proof ability and service life.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

Some particular embodiments of the invention will be described in detail for purpose of illustration, and one of ordinary skill in the art can easily understand the advantages and efficacy of the present invention through the disclosure of the specification. It is to be understood that alternative embodiments may be possible for the implement and application of the present invention while numerous variations will be possible to the details disclosed in the specification on the strength of diverse concepts and applications without going outside the scope of the invention as disclosed in the claims.

Figure 1:
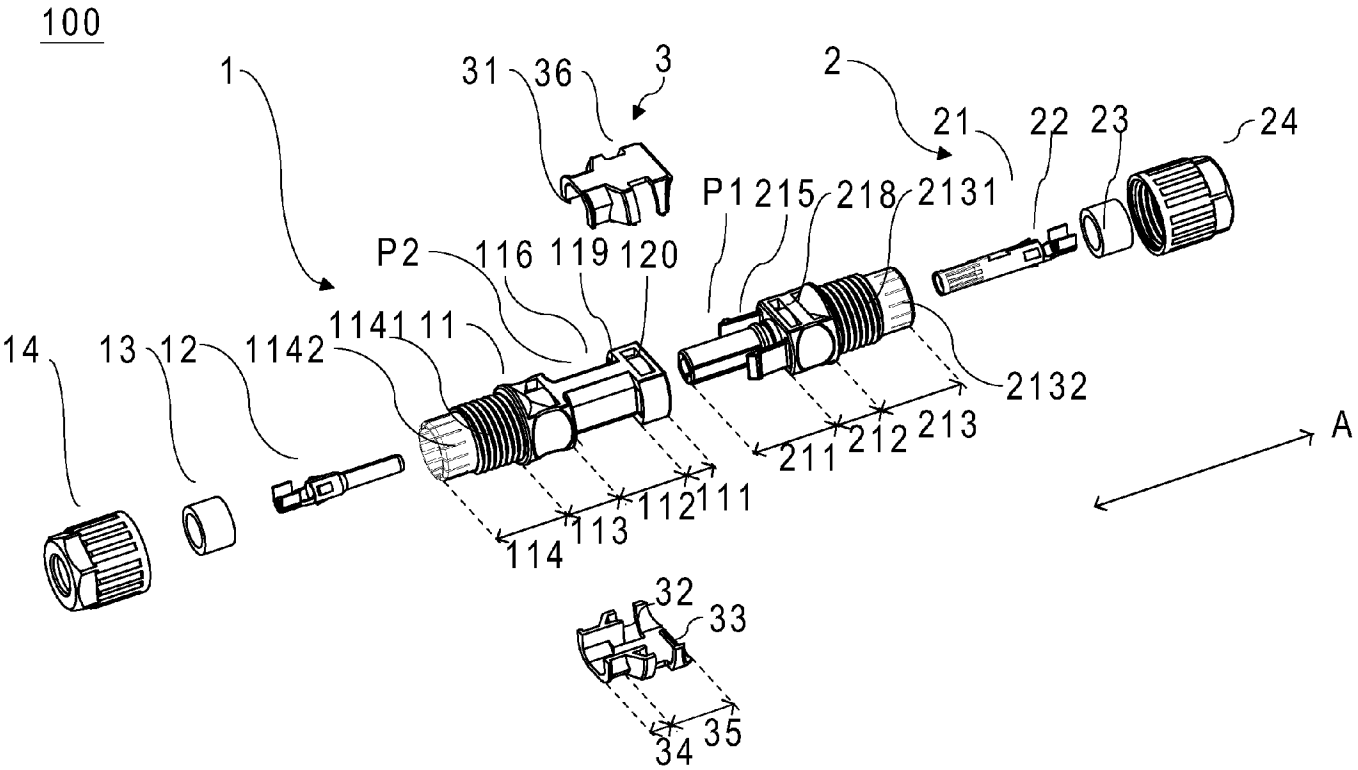
FIG. 1 is an exploded view of a water-proof connector assembly according to the first preferred embodiment of the present invention.

Please refer to FIG. 1. The first preferred embodiment of the present invention is a water-proof connector assembly 100. This water-proof connector assembly 100 comprises a first connecting device 1, a second connecting device 2 and a fastener 3, wherein the first connecting device 1, the second connecting device 2 and the fastener 3 are assembled along a predetermined axis A. The first connecting device 1 includes a first casing 11, a male conductive terminal 12, a water-resisting member 13 and a first screwing member 14. The second connecting device 12 includes a second casing 21, a female conductive terminal 22, a second water-proof sleeve 23 and a second screwing member 24. The aforementioned first casing 11, the second casing 12 and the fastener 3 are all tubular in shape.

Figure 2:
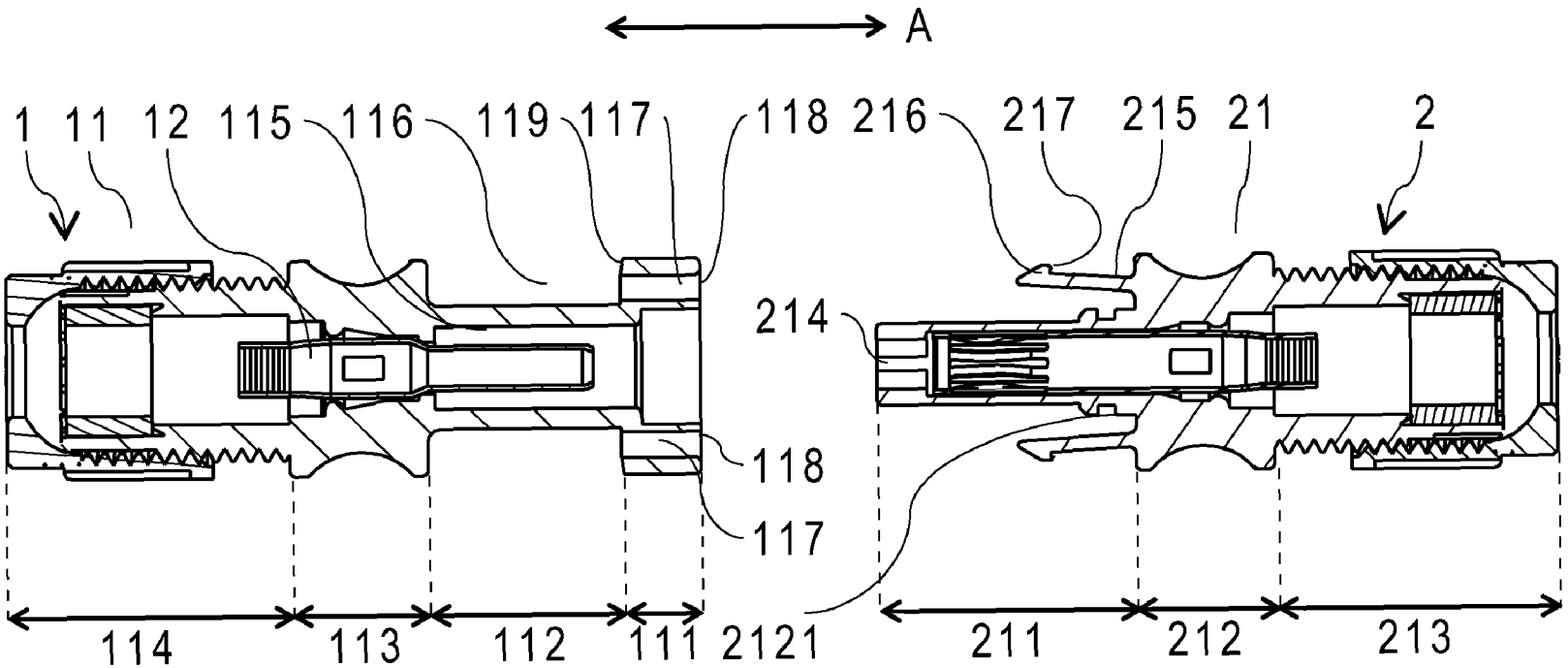
FIG. 2 is a cross-sectional view of a first connecting device and a second connecting device according to the first preferred embodiment of the present invention.

Please refer to FIG. 2, which is a cross-sectional view of the disassembled first connecting device 1 and second connecting device 2 taken along the predetermined axis A according to the first preferred embodiment of the present invention. The first casing 11 has a first inner hole 115 extending along the predetermined axis A. The first casing 11 is provided with successively a first section 111, a second section 112, a third section 113 and a fourth section 114 along the predetermined axis A. The second section 112 is sunken inwardly to form a pair of recessed portions 116. The first section 111 has a pair of through holes 117 extending along the predetermined axis A. Each of the pair of through holes 117 passes through each of the pair of recessed portions 116 through a pair of first openings 118. The pair of recessed portions 116 are further provided with a pair of first retaining areas 119. It is to be noted that the pair of first retaining areas 119 are disposed at a pair of outer sides (not shown) of the pair of first openings 118.

Still referring to FIG. 2, the second casing 21 has a second inner hole 214 extending along the predetermined axis A. The second casing 21 is provided with successively a fifth section 211, a sixth section 212 and a seventh section 213 along the predetermined axis A. The fifth section 211 engages with the first inner hole 115 of the first casing 11. The second casing 21 further comprises a pair of retaining arms 215, which are extended from a top 2121 of the sixth section 212 along the predetermined axis A and located outside the fifth section 211. The pair of retaining arms 215 have a pair of terminals (not shown) projecting outwardly to form a pair of projecting portions 216. It is to be noted that the pair of projecting portions 216 have a pair of second retaining areas (217) formed at a side adjacent to each of the pair of retaining arm 215.

Figure 3:
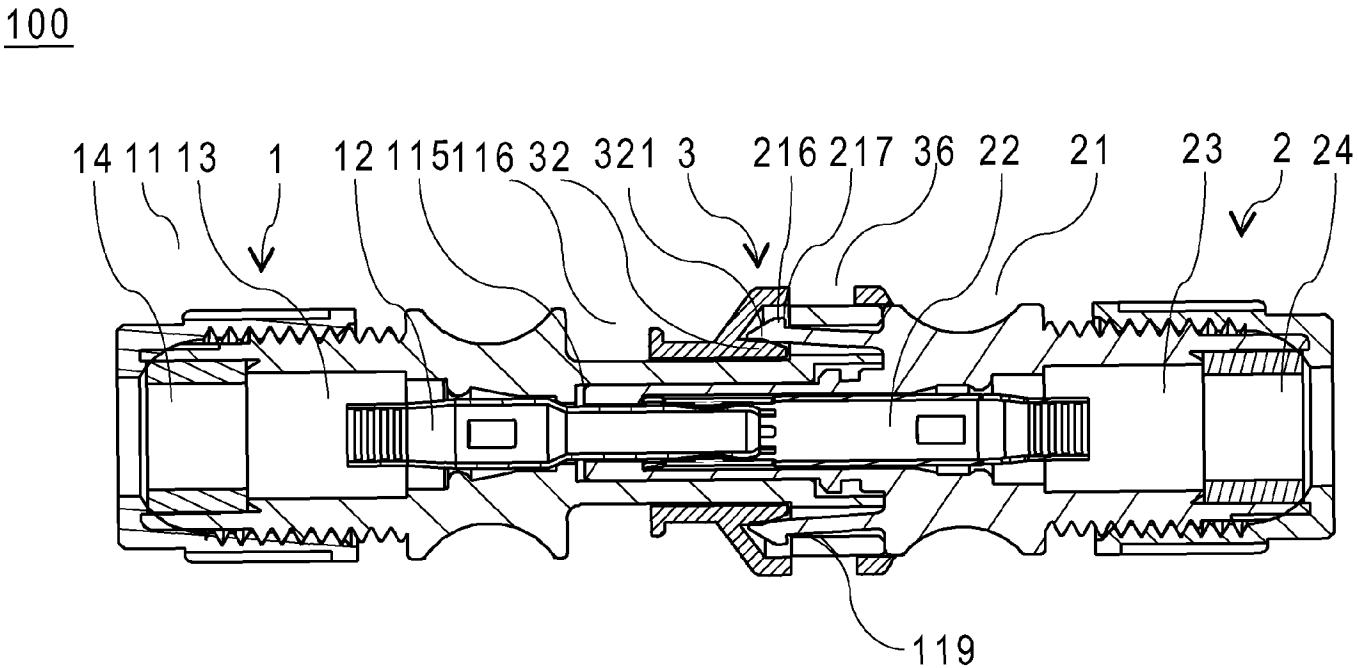
FIG. 3 is a cross-sectional view of a water-proof connector assembly according to the first preferred embodiment of the present invention.

Please refer to FIG. 3, which is a cross-sectional view of the assembled first connecting device 1 and second connecting device 2 taken along the predetermined axis A according to the first preferred embodiment of the present invention. Particularly, each of the pair of projecting portions 216 passes through each of the pair of through holes 117 of the first casing 11 to engage with each of the pair of recessed portions 116.

Still referring to FIG. 3, the above-mentioned male conductive terminal 12 is disposed in the first casing 11 while the above-mentioned female conductive terminal 22 is disposed in the second casing 21. Thus, when the first connecting device 1 and the second connecting device 2 are assembled, the fifth section 211 of the second casing 21 engages with in the first inner hole 115 of the first casing 11. Thereby, the female conductive terminal 22 in the second casing 21 allows the male conductive terminal 12 in the first casing 11 to be inserted thereto, so as to conduct electricity.

Figure 4:
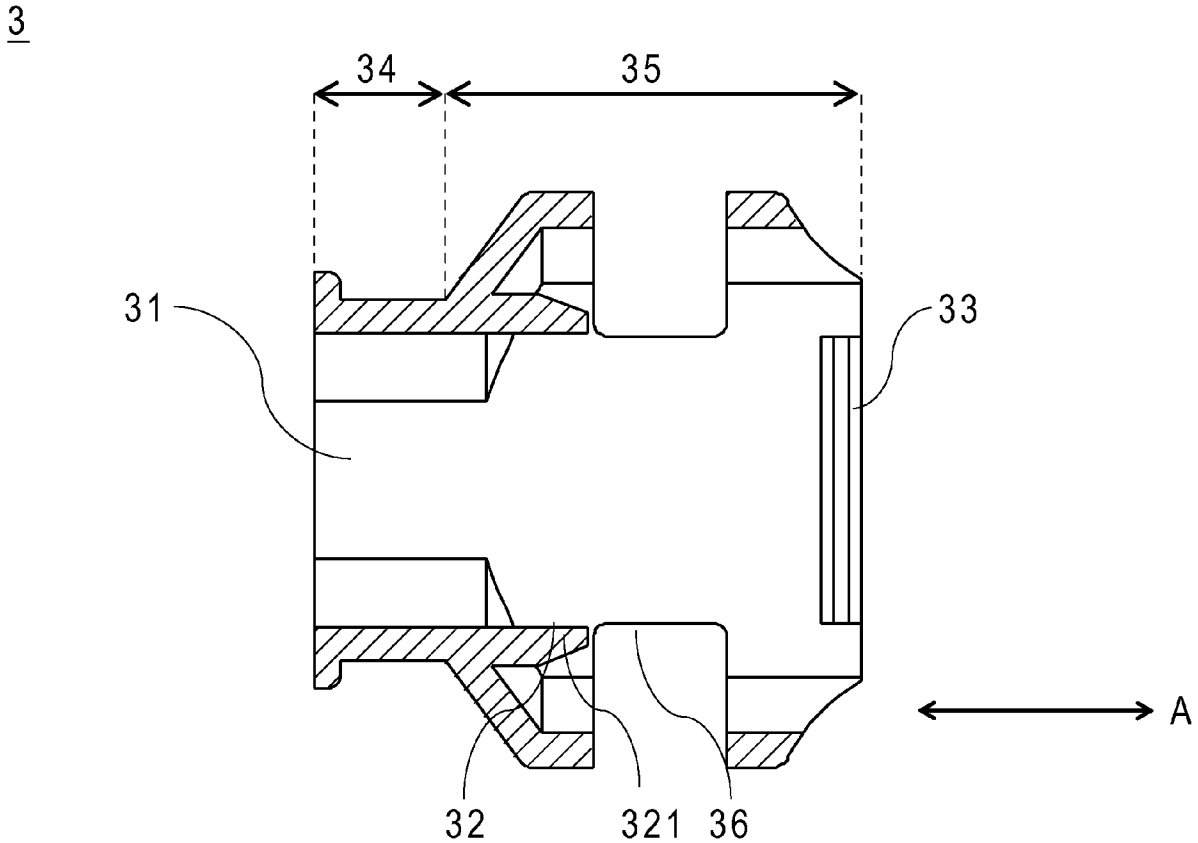
FIG. 4 is a cross-sectional view of a fastener according to the first preferred embodiment of the present invention.

Please refer to FIG. 1, FIG. 3 and FIG. 4. FIG. 4 is a cross-sectional view of the fastener 3 taken along the predetermined axis A according to the first preferred embodiment of the present invention. The fastener 3 has a third inner hole 31 extending along the predetermined axis A. Particularly, the fastener 3 is mounted around the first section 111 and the second section 112 of the first casing 11, thereby the fastener 3 is movable on a first outer surface (not shown) of the first section 111 and the second section 112 between a predetermined first position P1 and a predetermined second position P2. In addition, the fastener 3 has a pair of tongues 32 extending along the predetermined axis A. Therefore, when the fastener 3 is located at the predetermined first position P1 on the assembled first connecting device 1 and the second connecting device 2, each of the pair of tongues 32 is positioned below each of the pair of projecting portions 216 of the second casing 21. Besides, each of the pair of second retaining areas 217 of each of the pair of projecting portions 216 contacts with each of the pair of first retaining areas 119 of the first casing 11. Hence, the water-proof connector assembly 100 of the present invention implements the fastener 3 to secure connection between the first connecting device 1 and the second connecting device 2, which is unlikely to loose or be taken apart due to external impact or unintentional force, so as to ensure durable electrical conductivity of the water-proof connector assembly 100.

Referring now to FIG. 1, FIG. 3 and FIG. 4, when the fastener 3 is located at the predetermined second position P2, each of the pair of tongues 32 is no more positioned below each of the pair of projecting portions 216 of the second casing 21.

Referring to FIG. 4, the fastener 3 further includes a pair of teeth 33 extruded inwardly from a wall (not shown) of the third inner hole 31.

Figure 5:
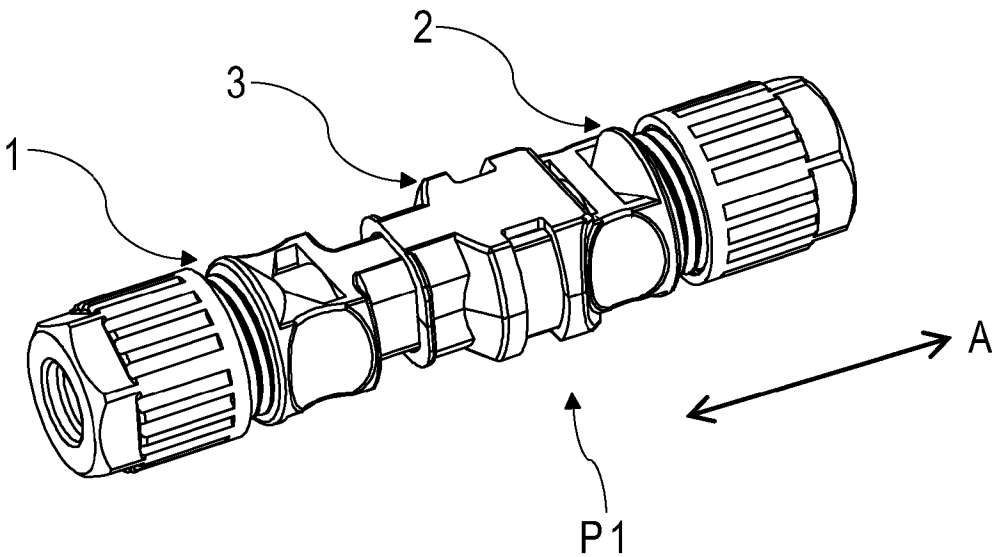
FIG. 5 is a schematic view of a water-proof connector assembly according to the first preferred embodiment of the present invention.

Referring back to FIG. 1, the sixth section 212 of the second casing 21 has a pair of first retaining holes 218 while the first section 111 of the first casing 11 has a pair of second retaining holes 120. Accordingly, when the fastener 3 is located at the predetermined first position P1, each of the pair of teeth 33 engages with each of the pair of first retaining holes 218. Thereby, the fastener 3 implements the pair of teeth 33 to help the first connecting device 1 and the second connecting device 2 to be connected more firmly (as shown in FIG. 5) with less risk of loosening or being taken apart under external impact or unintentional force, thereby better ensuring durable electrical conductivity of the assembled water-proof connector assembly 100 and its users' safety. Moreover, when the fastener 3 is located at the predetermined second position P2, each of the pair of teeth 33 engages with each of the pair of second retaining holes 120 so that the fastener 3 uses the pair of teeth 33 to firmly hold the first section 111 and the second section 112 of the first casing 1 without hindering the connection between the first connecting device 1 and the second connecting device 2.

Still referring to FIG. 4, each of the pair of tongues 32 of the fastener 3 has a front end formed with a ramp 321. Referring back to FIG. 3, when the fastener 3 is located at the predetermined first position P1, each of the pair of the ramps 321 at the front ends of each of the pair of tongues 32 guides each of the pair of tongue 32 to be positioned below each of the pair of projecting portions 216 of the second casing 21 more smoothly, so that each of the pair of second retaining areas 217 of each of the pair of projecting portions 216 contacts with each of the pair of first retaining areas 119 of the first casing 11.

Still referring to FIG. 4, the fastener 3 is further successively provided with an eighth section 34 and a ninth section 35. While the eighth section 34 is in mutual contact with the second section 112 of the first casing 11, the ninth section 35 is located outer than the eighth section 34. It is also to be stated that each of the pair of the tongues 32 extends from the eighth section 34 into the ninth section 35.

Furthermore, moving the fastener 3 on the water-proof connector assembly 100 may be achieved manually or may be achieved by means of a tool or a device. Thus, also referring to FIG. 4, the fastener 3 is further provided with a pair of notches 36. Particularly, each of the pair of notches 36 is located between each of the pair of tongues 32 and each of the pair of teeth 33. The pair of notches 36 are primarily configured to be engaged with a tool or a device that exerts a force to move the fastener 3 from the predetermined second position P2 to the predetermined first position P1 or from the predetermined first position P1 to the predetermined second position P2.

Referring back to FIG. 1, the fourth section 114 of the first casing 11 has a second outer surface (not shown) formed with a first externally threaded portion 1141 for engaging with the first screwing member 14. Furthermore, the fourth section 114 is provided with a plurality of first axial interstices 1142, so the first water-proof sleeve 13 is allocated within the first externally threaded portion 1141 and the male conductive terminal 12 is inserted into the first water-proof sleeve 13. In addition, the seventh section 213 of the second casing 21 has a third outer surface (not shown) formed with a second externally threaded portion 2131 for engaging with the second screwing member 24. Furthermore, the seventh section 213 is provided with a plurality of second axial interstices 2132, so the second water-proof sleeve 23 is allocated within the second externally threaded portion 2131, and the female conductive terminal 22 is inserted into the second water-proof sleeve 23. Therefore, in virtue of the first water-proof sleeve 13 and the second water-proof sleeve 23, damp or moisture is blocked from entering the first connecting device 1 and the second connecting device 2, thereby improving the water-proof connector assembly 100 in water-proof ability and service life.

Although some particular embodiments of the invention have been described in detail for purposes of illustration, it will be understood by one of ordinary skill in the art that numerous variations will be possible to the disclosed embodiments without going outside the scope of the invention as disclosed in the claims.

What is claimed is:

1. A water-proof connector assembly (100), comprising a first connecting device (1), a second connecting device (2) and a fastener (3), wherein the first connecting device (1), the second connecting device (2) and the fastener (3) are assembled along a predetermined axis (A), the first connecting device (1) comprising a first casing (11), a male conductive terminal (12), a first water-proof sleeve (13) and a first screwing member (14), the second connecting device (2) comprising a second casing (21), a female conductive terminal (22), a second water-proof sleeve (23) and a second screwing member (24), the female conductive terminal (22) allowing the male conductive terminal (12) to insert for conducting electricity, the first casing (11), the second casing (21) and the fastener (3) all being tubular in shape; the water-proof connector assembly (100) being characterized in:

the first casing (11) has a first inner hole (115) extending along the predetermined axis (A), the first casing (11) is provided successively a first section (111), a second section (112), a third section (113) and a fourth section (114) along the predetermined axis (A), the second section (112) has a pair of recessed portions (116) sunken inwardly, the first section (111) has a pair of through holes (117) extending along the predetermined axis (A), each of the pair of through holes (117) passes through each of the pair of recessed portions (116) through a pair of first openings (118), the pair of recessed portions (116) further has a pair of first retaining areas (119) disposed at a pair of outer sides of the pair of first openings (118);

the second casing (21) has a second inner hole (214) extending along the predetermined axis (A), the second casing (21) is provided successively a fifth section (211), a sixth section (212) and a seventh section (213) along the predetermined axis (A), the fifth section (211) engages with the first inner hole (115) of the first casing (11), the second casing (21) further comprises a pair of retaining arms (215) extending along the predetermined axis (A) from a top (2121) of the sixth section (212), wherein the pair of retaining arms (215) are located outside the fifth section (211), the pair of retaining arms (215) have a pair of terminals projecting outwardly to form a pair of projecting portions (216), the pair of projecting portions (216) have a pair of second retaining areas (217) formed at a side adjacent to each of the pair of retaining arm (215), each of the pair of projecting portions (216) passes through each of the pair of through holes (117) of the first casing (11) to engage with each of the pair of recessed portions (116); and the fastener (3) has a third inner hole (31) extending along the predetermined axis (A), the fastener (3) is mounted around the first section (111) and the second section (112) of the first casing (11), and the fastener (3) is movable on a first outer surface of the first section (111) and the second section (112) between a predetermined first position (P1) to a predetermined second position (P2), the fastener (3) has a pair of tongues (32) extending along the predetermined axis (A), so that when the fastener (3) is located at the predetermined first position (P1), each of the pair of tongues (32) is positioned below each of the pair of projecting portions (216) of the second casing (21), each of the pair of second retaining areas (217) of each of the pair of projecting portions (216) contacts with each of the pair of first retaining areas (119) of the first casing (11), each of the pair of tongues (32) is no more positioned below each of the pair of projecting portions (216) when the fastener (3) is located at the predetermined second position (P2).

2. The water-proof connector assembly (100) of claim 1, wherein:

the fastener (3) further includes a pair of teeth (33) extruded inwardly from a wall of the third inner hole (31);

the sixth section (212) of the second casing (21) has a pair of first retaining holes (218);

the first section (111) of the first casing (11) has a pair of second retaining holes (120);

each of the pair of teeth (33) engages with each of the pair of first retaining holes (218) when the fastener (3) is located at the predetermined first position (P1); and each of the pair of teeth (33) engages with each of the pair of second retaining holes (120) when the fastener (3) is located at the predetermined second position (P2).

3. The water-proof connector assembly (100) of claim 1, wherein each of the pair of tongues (32) of the fastener (3) has a front end formed with a ramp (321).

4. The water-proof connector assembly (100) of claim 1, wherein the fastener (3) is further provided successively with an eighth section (34) and a ninth section (35), the eighth section (34) being in mutual contact with the second section (112) of the first casing (11), the ninth section (35) being located outer than the eighth section (34), each of the pair of the tongues (32) extends from the eighth section (34) into the ninth section (35).

5. The water-proof connector assembly (100) of claim 4, wherein the ninth section (35) of the fastener (3) has a pair of notches (36), each of the pair of notches (36) being located between each of the pair of tongues (32) and each of the pair of teeth (33).

6. The water-proof connector assembly (100) of claim 1, wherein the fourth section (114) of the first casing (11) has a second outer surface formed with a first externally threaded portion (1141) for engaging with the first screwing member (14).

7. The water-proof connector assembly (100) of claim 6, wherein:

the fourth section (114) of the first casing (11) further includes a plurality of first axial interstices (1142);

the first water-proof sleeve (13) is allocated within the first externally threaded portion (1141); and the male conductive terminal (12) is inserted into the first water-proof sleeve (13).

8. The water-proof connector assembly (100) of claim 1, wherein the seventh section (213) of the second casing (21) has a third outer surface formed with a second externally threaded portion (2131) for engaging with the second screwing member (24).

9. The water-proof connector assembly (100) of claim 8, wherein:

the seventh section (213) of the second casing (21) further includes a plurality of second axial interstices (2132);

the second water-proof sleeve (23) is allocated within the second externally threaded portion (2131); and the female conductive terminal (22) is inserted into the second water-proof sleeve (23).

* * * * *